US005127555A

United States Patent [19]

Mittermaier

[11] Patent Number: 5,127,555

[45] Date of Patent: Jul. 7, 1992

[54] SUBMERGED PUMP MANIFOLD WITH ELECTRICAL INTERLOCKED CHANGEABLE FILTER

[75] Inventor: Armin E. Mittermaier, Fort Wayne, Ind.

[73] Assignee: Tokheim Corporation, Fort Wayne, Ind.

[21] Appl. No.: 658,078

[22] Filed: Feb. 20, 1991

[51] Int. Cl.[5] ..... B67D 5/16; B67D 5/58

[52] U.S. Cl. ..... 222/189; 210/234; 222/71; 222/192; 222/333; 222/372; 417/423.9

[58] Field of Search ..... 222/71, 189, 333, 377, 222/372, 382, 192, 74; 210/234; 417/423.9, 313

[56] References Cited

U.S. PATENT DOCUMENTS

| | | | |
|---|---|---|---|
| 2,488,770 | 11/1949 | Foulds | 210/234 |
| 2,885,126 | 5/1959 | Hudson | 222/333 |
| 2,913,987 | 11/1959 | Clymer | 222/333 |
| 2,937,755 | 5/1960 | Szwargulski | 417/423.9 X |
| 2,963,203 | 12/1960 | Hoelle | 222/333 |
| 2,997,209 | 8/1961 | Daniele | 222/71 |
| 3,020,849 | 2/1962 | Reynolds | 103/87 |
| 3,197,085 | 7/1965 | Deters et al. | 222/333 |
| 3,368,679 | 2/1968 | Bozek | 210/234 X |
| 3,399,776 | 9/1968 | Knuth | 210/234 |
| 3,746,171 | 7/1973 | Thomsen | 210/234 |

*Primary Examiner*—Kevin P. Shaver
*Attorney, Agent, or Firm*—Baker & Daniels

[57] ABSTRACT

A submerged pump manifold for a liquid fuel dispensing system. The pump manifold includes a chamber for housing a filter cartridge and a cover attached to the top of the chamber. An interlock device is removably attached to the cover such that the device must be removed upon removing the cover. The interlock device is attached to a plug-type connection on the pump manifold so that as the interlock device is rotated away from the cover, the plug-type connection is moved from its plugged-in position to its unplugged position, thereby electrically disabling the submerged pump while the cover is removed.

17 Claims, 6 Drawing Sheets

SUBMERGED PUMP MANIFOLD WITH ELECTRICAL INTERLOCKED CHANGEABLE FILTER

BACKGROUND OF THE INVENTION

The present invention relates generally to filters for a liquid fuel dispensing system and more particularly to such a system having a submerged pump manifold.

Fluid dispensers for dispensing fuels such as gasoline, fuel oil, and the like are well known in the art and over a period of years have experienced a substantial evolution in design. Most liquid fuel dispensing equipment generally includes a pump connected to a fuel reservoir, a valved nozzle adapted to be inserted in the fuel pipe of a vehicle fuel tank, and a flexible fuel hose connected between the pump outlet pipe and the valve nozzle.

In current fuel dispensing installations, such as in gasoline service stations, there are generally one or more "islands". Each island includes a plurality of conventional metering consoles in which each console includes a nozzled dispensing hose. A filter is located within each individual console cabinet and is designed to filter the gasoline that is dispensed through the nozzle.

Periodically, the filters of each console require servicing. When it is desired to change a filter in any particular console, it is necessary to block off the island to minimize the risk of being struck by a motor vehicle. In addition, the island is blocked off to prevent any further consoles within the island to be utilized. A problem with blocking off an entire island is that vehicle traffic is often impeded throughout the remainder of the service station.

When changing a filter, the console cabinet is removed, and the filter is unscrewed from the fuel conduit located within the dispenser. At this point the fuel line is open. In the event that improper procedures are followed in blocking off the island, a customer may use another console at the same island. Therefore, there is the possibility that the submerged pump will begin pumping gasoline through the open fuel line and onto the servicing technician.

In addition to potential safety problems, there is a possibility that fuel may be spilled onto the ground when removing filters from within the consoles. Presently, if more than one kilogram of fuel is spilled onto the ground, it must be reported to the EPA for corrective action. When removing filters from existing consoles, there is a possibility that fuel may be spilled onto the ground.

It is desired to provide a gasoline dispenser system in which the filters may be serviced more safely and with fewer product leaks.

SUMMARY OF THE INVENTION

The present invention overcomes the disadvantages of the above-described prior art by providing a fuel dispensing system in which the submerged pump is automatically disabled upon servicing of a filter that is located remote from the metering consoles.

Generally, the present invention provides a liquid fuel dispensing system having a liquid fuel reservoir and a fuel pump submerged within the fuel reservoir for pumping the fuel from the reservoir to a plurality of remote dispensing nozzles. A filter cartridge is located near the submerged pump for filtering the fuel as it is pumped to the individual nozzles. A disabling device is attached to the submerged pump such that the pump is disabled upon accessing the filter for service.

Specifically, the invention provides a submerged pump manifold having a chamber and a cover to provide access for servicing a filter cartridge located in the chamber. An interlock device is removably attached to the cover such that the device must be removed upon removing the cover. The interlock device is attached to a bolt which actuates an electrical plug connection within the pump manifold. In order to remove the interlock device from the cover, the plug connection is unplugged to electrically disable the pump while the cover is removed.

An advantage of the dispensing system of the present invention is that only one filter is utilized for filtering the fuel to each metering console thereby reducing the number of parts and overall cost of having filtered gasoline.

Another advantage of the dispensing system of the present invention is that the submerged pump is automatically disabled upon servicing the filter thereby protecting the service technician from being sprayed with gasoline by inadvertent operation of the submerged pump.

Another advantage of the dispensing system of the present invention is that traffic is not impeded when performing filter changes since the fuel reservoirs are set away from the traffic islands.

A further advantage of the dispensing system of the present invention is that the use of rigid conduits within the metering consoles is eliminated since there is no servicing of the filter from within the console cabinets.

Another advantage of the dispensing system of the present invention is that the elimination of filtering equipment from within the individual metering consoles allows devices such as money acceptors to be built into the console cabinet, adjacent the dispensing nozzle.

Still another advantage of the dispensing system of the present invention is that after the filter cover is removed, the fuel product in the manifold of the submerged pump falls back through the supply pipe into the underground tank thus preventing the spillage of product upon servicing of the filter.

Another advantage of the dispensing system of the present invention is that foreign products are prevented from entering the fuel lines since the fuel lines in each metering console need not be opened for servicing individual filters.

Another advantage of the dispensing system of the present invention is that any open product lines during changing of the submerged pump filter will be away from the customers using the dispensers.

The present invention, in one form thereof, comprises a liquid fuel dispensing system including a liquid fuel reservoir and a valved nozzle. A fluid conduit provides fluid communication between the reservoir and the nozzle. A pump is provided in the reservoir pumping fuel through the conduit. A filter is located intermediate the pump and the nozzle for filtering fuel that is pumped by the pump. The filter includes a disabling device for automatically disabling operation of the pump upon servicing of the filter.

In another aspect of the invention, the fuel dispensing system includes an electric pump in the fuel reservoir in which the pump is connectable to a source of energy. The pump and the filter comprise a pump manifold which has a chamber therein to receive a filter cartridge and a cover to provide access to the chamber. An interlock mechanism is secured to the cover of the filter chamber such that upon removal of the cover for servicing of the filter, the pump is automatically electrically disconnected from its source of energy.

DESCRIPTION OF THE PREFERRED EMBODIMENT

Figure 1:
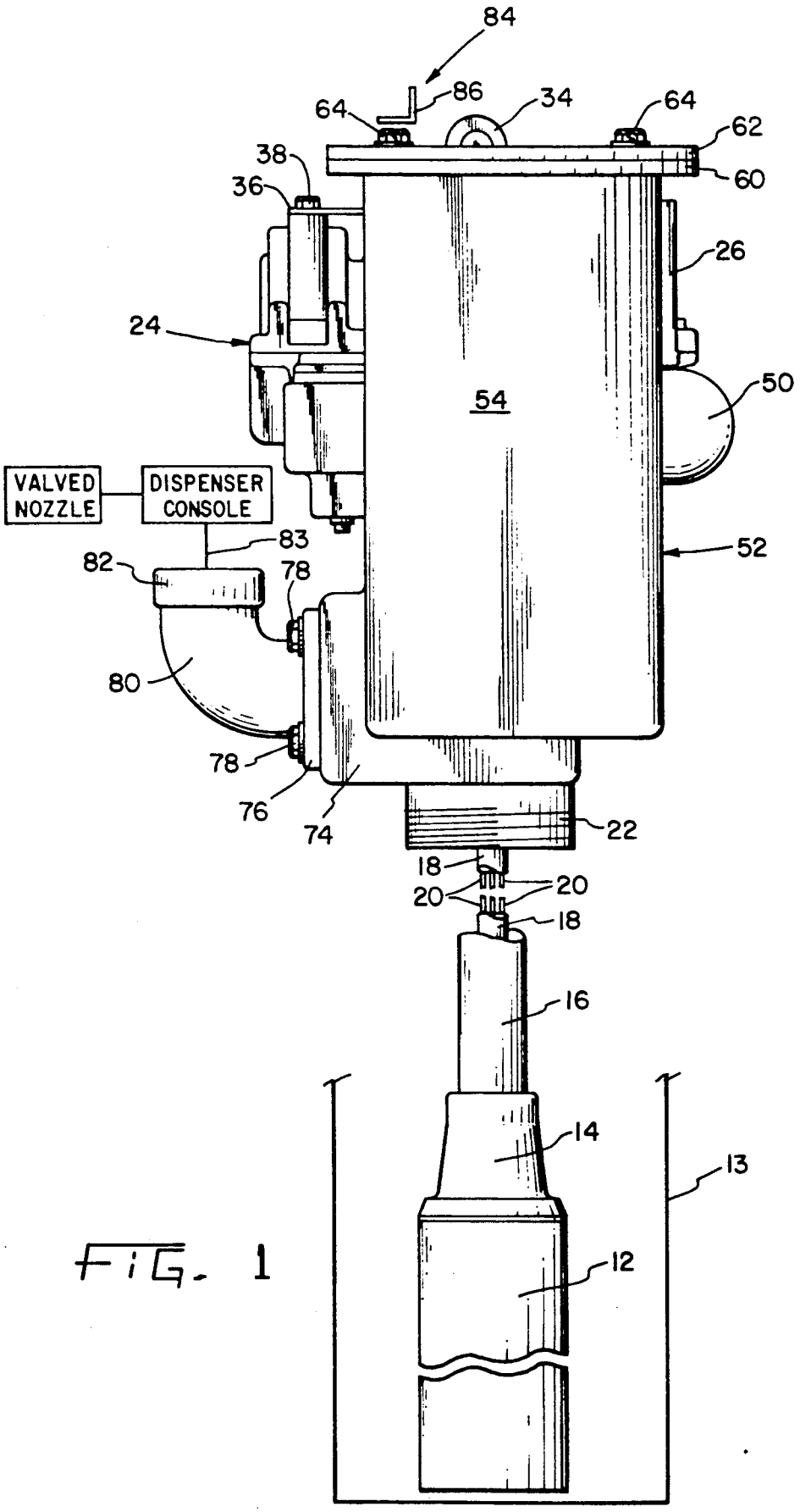
FIG. 1 is an elevational view of the submerged pump motor unit including a pump manifold according to the present invention.

Referring to FIG. 1, there is shown a motor pump unit 12 submerged in a liquid fuel reservoir 13 and which is fitted at its upper end with a cap 14 which receives a cylindrical tube 16. An electric wire conduit 18 is received within tube 16 so that one end of conduit 18 is sealingly attached to motor pump unit 12. Wires 20 which are attached to the motor at one end, extend through conduit 18. A nipple 22 is fixedly mounted in a flange (not shown) that is attached to the top of the underground tank. A manifold 24 is suitably sealed on nipple 22, and wires 20 extend through a conduit (not shown) into the wiring connections of manifold 24. Manifold 24 includes the conventional inlet and outlet chambers for the delivery of fuel therethrough. In particular, manifold 24 includes a body 26, which houses a siphon assembly 28 attached to body 26 by bolts 29, a line test plug 30, an eyelet 32 for lifting manifold 24, a wiring connection assembly 33, and a capacitor assembly 34. Cover 36 is secured to body 26 by bolts 38. Manifold 24 further includes a crossbar 40 secured to the manifold by bolt 42. A transverse bar 44 includes an end 46 which is welded to crossbar 40, and a free end 48 which electrically discharges capacitor 34 when the voltage supply is terminated to motor pump unit 12.

A pipe 50 is secured to the discharge outlet of manifold 24 to provide the fuel inlet for filter chamber 52. Filter chamber 52 includes a generally cylindrical wall 54 having an inlet opening 56 and a outlet opening 58. Wall 54 includes an upper circular flange 60. A cover 62 is removably attached to flange 60 by bolts 64. A pleated filter cartridge 66, which is commercially available from Refilco of Perth Amboy, New Jersey, is removably disposed in filter chamber 52 for filtering the fuel as it flows from inlet 56 to outlet 58. Filter cartridge 66 includes a cylindrical support 68 surrounding a perforated tube 70, preferably made of stainless steel. Tube 70 supports pleated filter paper 72.

An outlet chamber 74 is located at the base of filter chamber 52 and includes a cap member 76, which is secured to outlet chamber 74 by bolts 78. An outlet pipe 80 in the form of an elbow connector is attached to outlet chamber 74 and includes a nipple 82 for connection with the delivery pipe 83 for the remote dispensers and valved nozzles.

Figure 2:
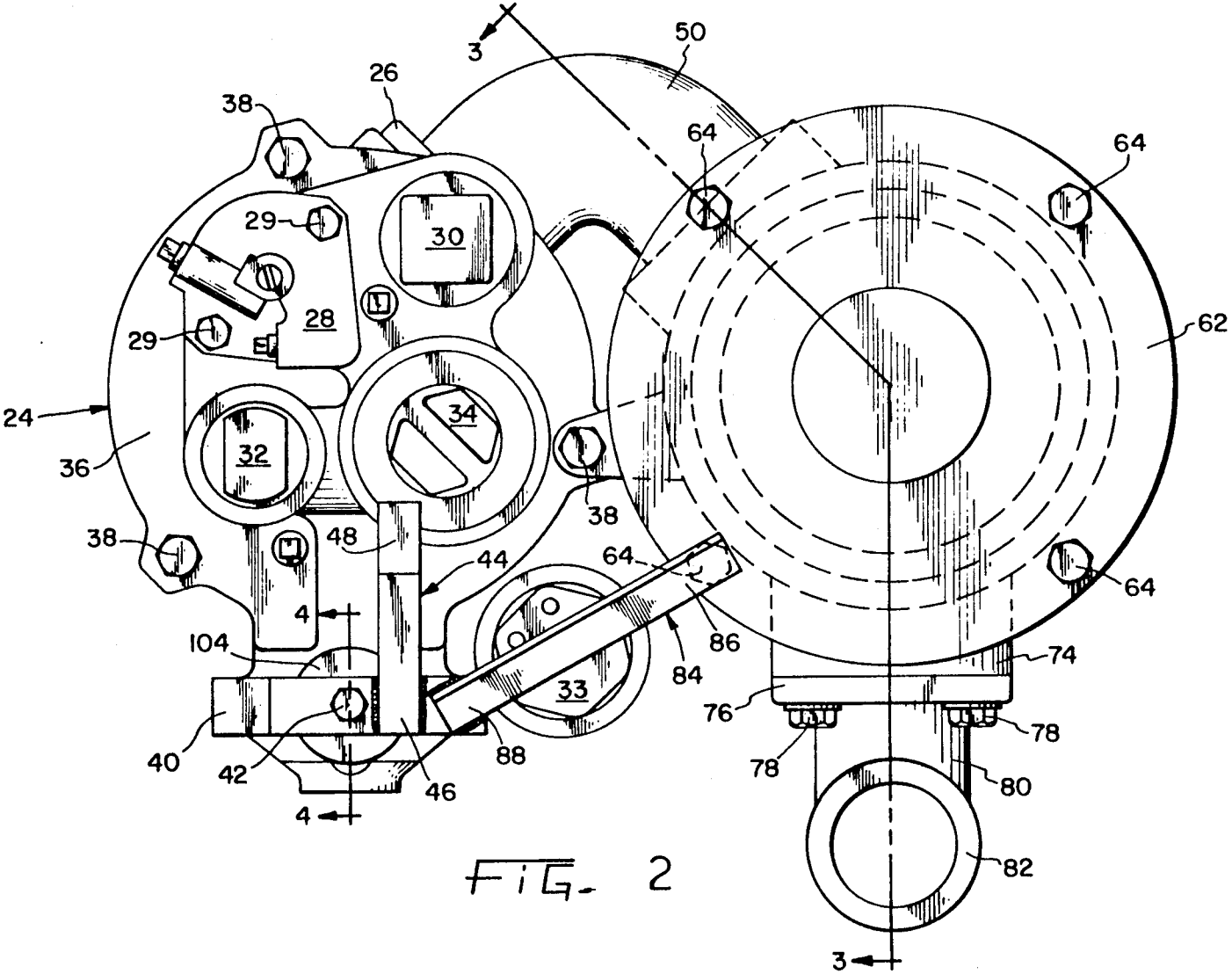
FIG. 2 is an enlarged top view of the unit of FIG. 1.
Figure 3:
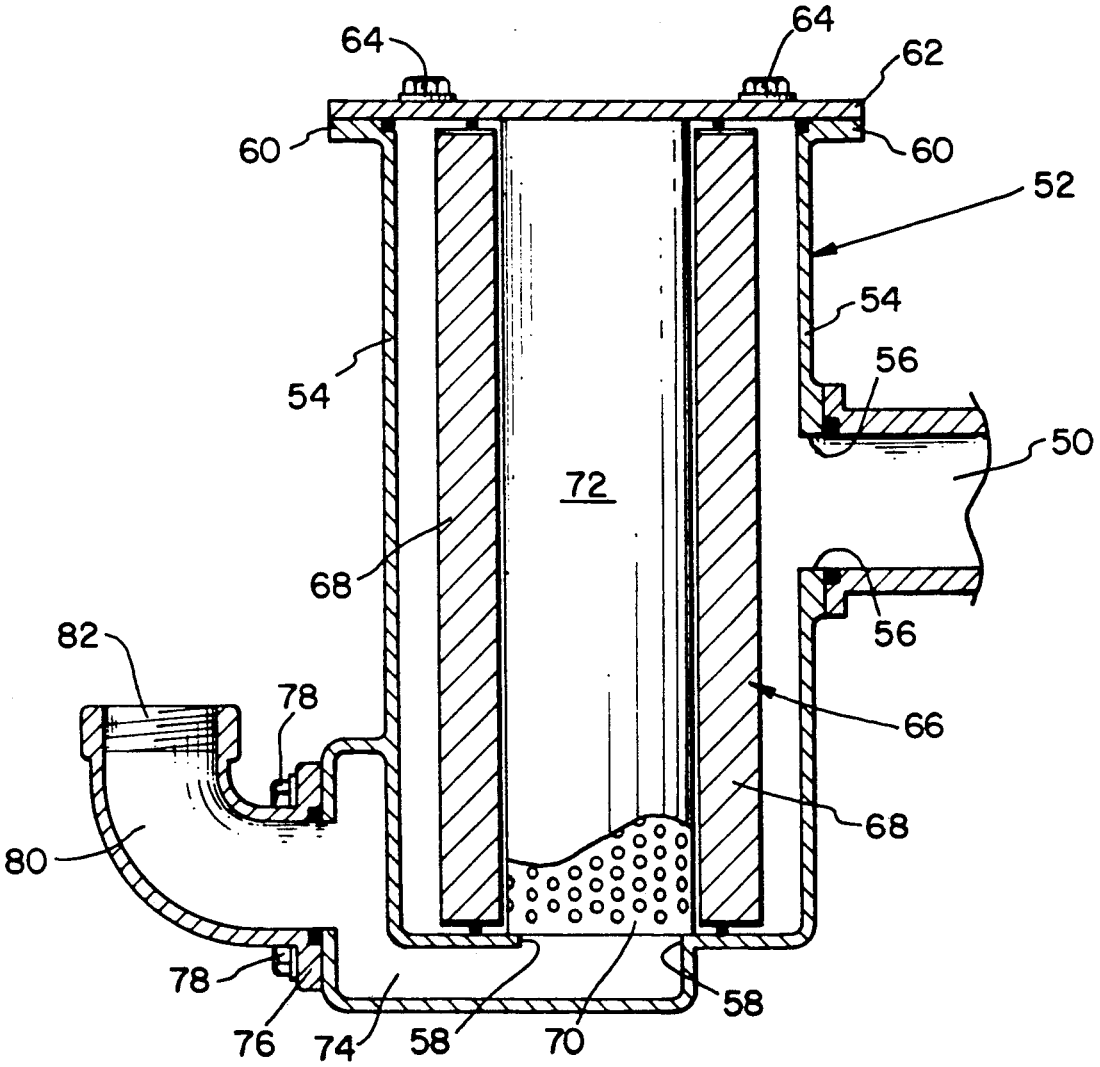
FIG. 3 is a sectional view of the unit of FIG. 1 taken along line 3—3 in FIG. 2.

Referring to FIG. 2, there is shown an interlock bar 84 in which one end 86 is secured to filter cover 62 by bolt 64, and the opposite end 88 is welded to crossbar 40. When it is desired to remove cover 62 from flange 60 of filter chamber 52 to gain access to filter cartridge 66, bolts 64 must be removed. In addition, interlock bar 84 must be removed before filter cover 62 can be removed. In order to remove interlock bar 84 from cover 62, bolt 64 must be removed from end 86 of interlock bar 84. In addition, bolt 42 must be loosened to allow crossbar 40, transverse bar 44, and interlock bar 84 to be rotated. The loosening of bolt 42 causes the main voltage to motor-pump unit 12 to be disconnected to prevent the submerged pump from being turned on while filter cartridge 66 is being serviced.

Figure 4:
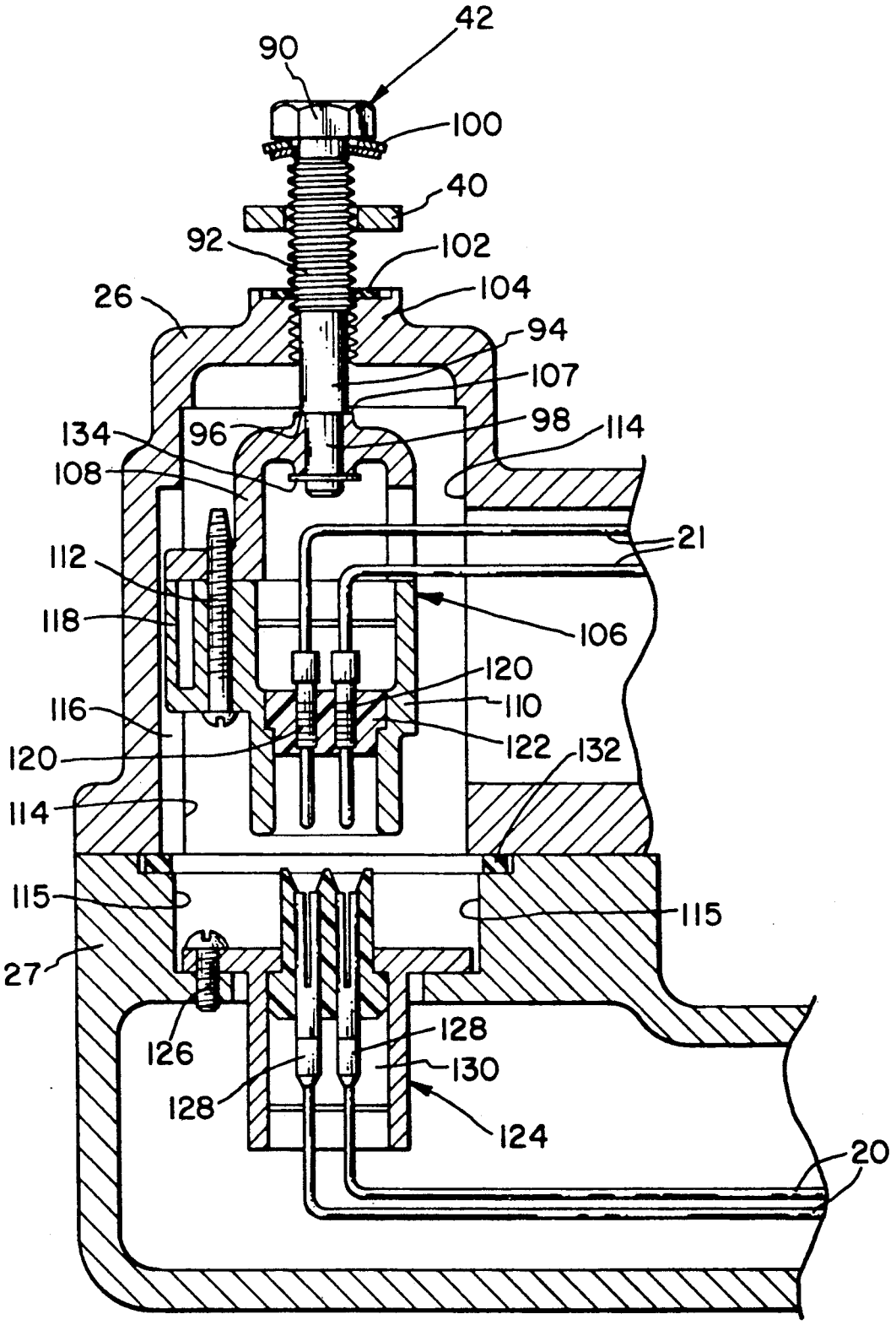
FIG. 4 is an enlarged fragmentary sectional view of the unit of FIG. 1, taken along line 4—4 in FIG. 2, particularly showing a plug-type connection actuated by an interlock mechanism according to the present invention, wherein the connection is shown in its unplugged position.
Figure 5:
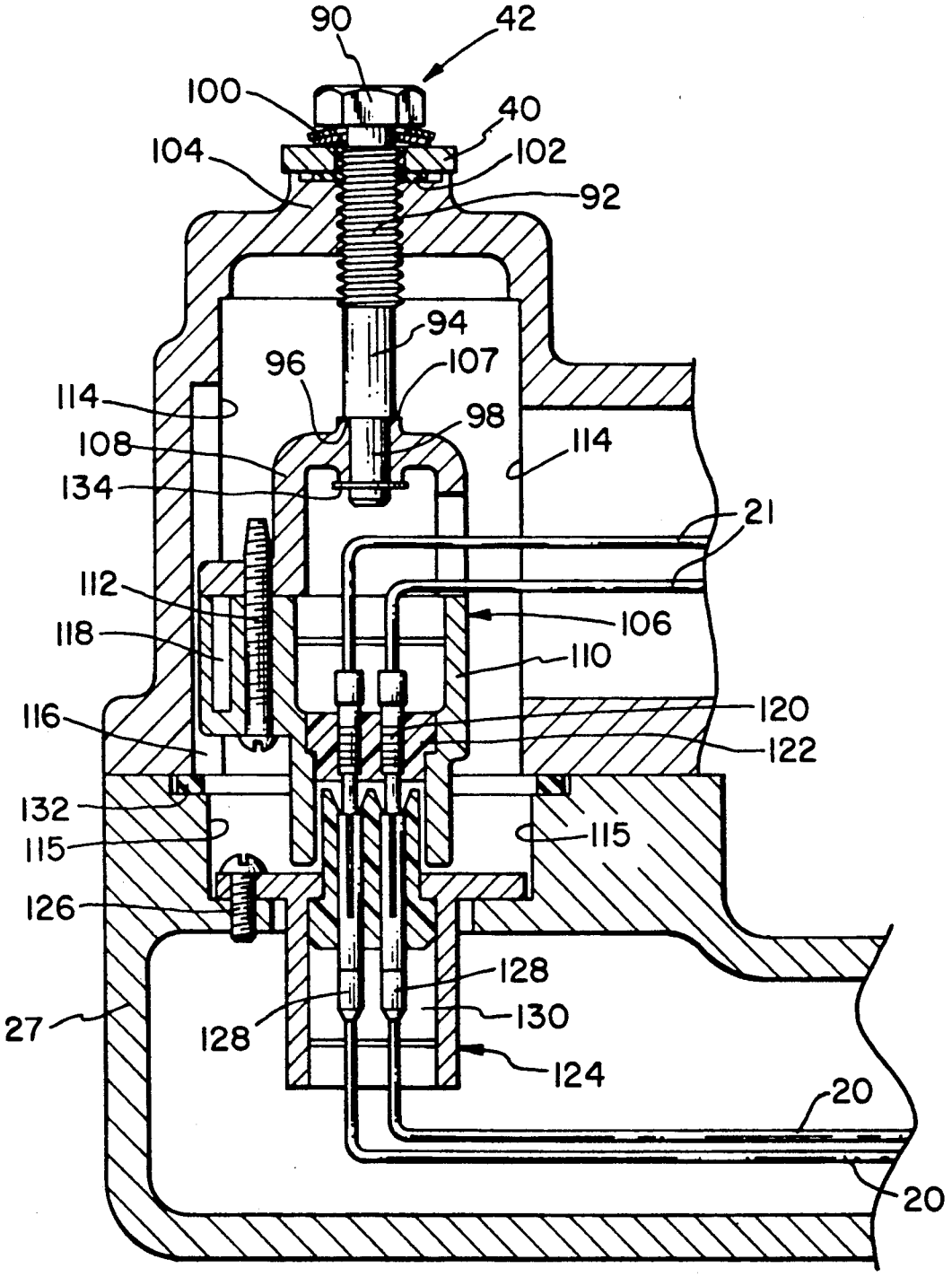
FIG. 5 shows the plug-type connection of FIG. 4 in its plugged-in position.

Referring now to FIGS. 4 and 5, there is shown bolt 42 having a head 90, an upper threaded portion 92, and a middle portion 94 which is undercut at 96 to form a reduced diameter portion 98. A spring washer 100 is attached to head 90 and provides a tight seal between head 90 and crossbar 40 as shown in FIG. 5. Similarly, washer 102 provides a tight seal between crossbar 40 and raised portion 104 of body 26. Reduced diameter portion 98 is rotatably journalled within a pin housing 106, which includes a shoulder 107 that engages undercut portion 96. Pin housing 106 includes an upper section 108 and a lower section 110, the upper and lower sections being secured by a screw 112. Pin housing 106 is axially guided within sealed chamber 114 along keyway 116 by guide key 118. Wires 21, which are connected to a voltage source, are connected to plug prongs 120, which are secured within pin housing 106 by bushing 122.

A receptacle housing 124 is secured to lower body 27 by screw 126. Wires 20, which are connected to motor-pump unit 12, are connected to receptacle prongs 128, which are secured within receptacle housing 124 by bushing 130. Lower chamber 115 is generally sealed from upper chamber 114 by washer 132. As shown in FIG. 5, plugs 120 are received in receptacles 128 while bolt 42 is tightened over crossbar 40, thereby permitting the voltage source to be electrically connected to the motor via wires 20 and 21. As shown in FIG. 4, plugs 120 are removed from receptacles 128 as bolt 42 is loosened, thereby electrically disabling the motor.

When it is desired to service filter cartridge 66, bolts 64 are removed from cover 62 of filter chamber 52. In order to remove one of the bolts, end 86 of interlock bar 84 must be removed from cover 62. After bolt 64 has been removed, cover 62 is still not removable due to the presence of interlock bar 84. In order to move interlock bar 84 away from cover 62, bolt 42 must first be loosened on crossbar 40. As bolt 42 is unscrewed and raised from its position in FIG. 5 to its position in FIG. 4, split retainer washer 134 raises pin housing 106 so that plugs 120 are removed from receptacles 128. Thus, by raising bolt 42, the voltage supply to wires 20 is terminated, thereby disabling motor pump unit 12 while the plug connection is in its unplugged position.

Once bolt 42 is raised, crossbar 40 may be rotated, thus rotating interlock bar 42 until end 86 is radially beyond the outer periphery of cover 62. At this point, there is sufficient clearance for cover 62 to be removed from filter chamber 52. Once cover 62 is removed, the fuel in manifold 24 falls back through the supply pipe into the underground tank, thus preventing the spillage of fuel in the pit adjacent the pump manifold. After a new filter cartridge is inserted into the chamber, cross bar 40 is rotated back to its original position, and nut 42 is tightened, causing undercut 96 to push downwardly on shoulder 107 of pin housing 106. This forces pin housing 106 downward so that plugs 120 are again forced into receptacles 128, which electrically connects the voltage supply to motor pump unit 12 as shown in FIG. 5. Bolts 64 are then tightened on cover 62, thus securing end 86 of interlock bar 84 to cover 62.

Figure 7:
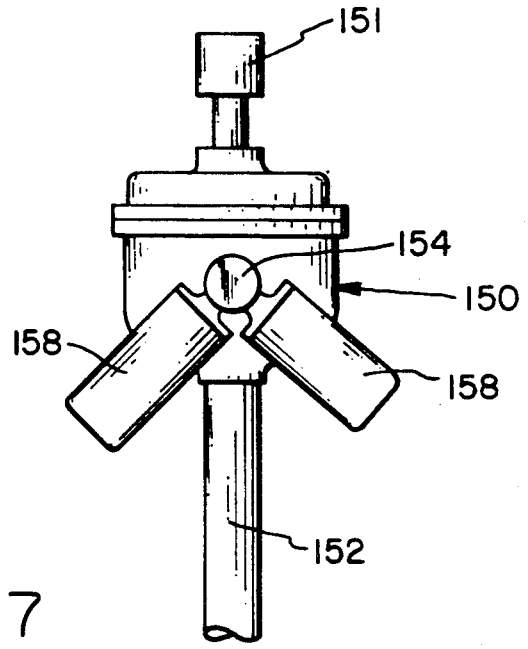
Figure 6:
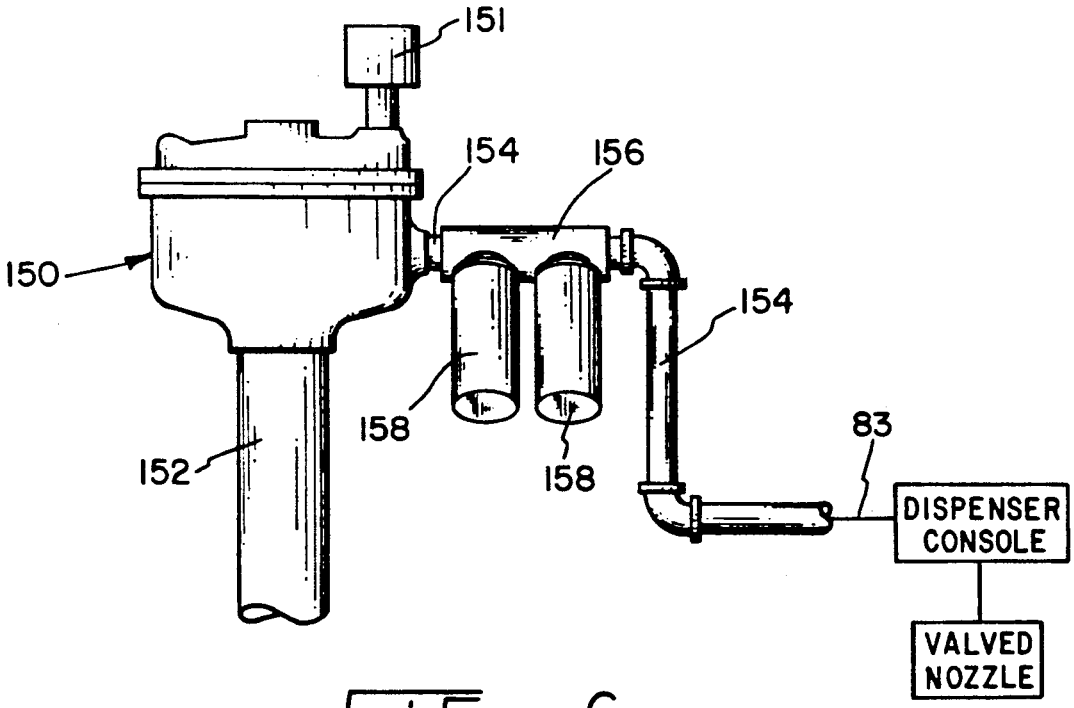
FIG. 6 is a front elevational view of an alternative embodiment to the pump manifold of FIG. 1, particularly showing a plurality of filter cartridges attached to the outlet pipe adjacent the pump manifold; and, FIG. 7 is a side view of the pump manifold of FIG. 6.

FIGS. 6 and 7 illustrate an alternative embodiment to the submerged pump motor unit of FIGS. 1-5. In particular, there is shown a pump manifold 150 having a pressure monitor 151 and being connected to an inlet pipe 152 and an outlet pipe 154. Outlet pipe 154 includes cylindrical sleeve 156 having threaded openings which threadedly receive filter cartridges 158. Filter cartridges 158 may be those that are used in existing metering consoles. Openings in outlet pipe 154 correspond to openings in sleeve 156 so that the fuel exiting pump manifold 150 is filtered through at least one cartridge 158. Such an arrangement eliminates the need for blocking off individual islands to service the filter cartridges.

What is claimed is:

1. A liquid fuel dispensing system, comprising:

a liquid fuel reservoir;

a valved nozzle;

a fuel conduit providing fluid communication between said reservoir and said nozzle;

pump means in said reservoir for pumping fuel through said conduit; and filter means intermediate said pump means and said nozzle for filtering the fuel that is pumped by said pump means, said filter means including disabling means for automatically disabling operation of said pump means upon servicing of said filter means.

2. The dispensing system according to claim 1, wherein said filter means comprises an inner chamber and a cover for providing access to said inner chamber for servicing of said filter means.

3. The dispensing system according to claim 2, wherein said disabling means comprises an interlock mechanism between said cover and said pump means, said interlock mechanism being detachably connected to said cover such that said pump means is automatically disabled upon removal of said interlock mechanism from said cover.

4. The dispensing system according to claim 2, wherein said filter means includes a changeable filter cartridge which is insertable in said inner chamber.

5. The dispensing system according to claim 1, wherein said pump means is electrically driven, and comprises a pump manifold, said filter means including a filter cartridge, and said pump manifold having a chamber therein to receive said filter cartridge.

6. The dispensing system according to claim 5, wherein said pump manifold includes a plug-type connection which has an unplugged position to prevent the flow of energy to said pump means and a plugged-in position to allow the flow of energy to said pump means.

7. The dispensing system according to claim 6, wherein a generally linear interlock mechanism is secured to said pump manifold, one end of said interlock mechanism being connected to said cover and the opposite end of said interlock mechanism being secured to said plug-type connection, whereby removal of said interlock mechanism from said cover moves said plug-type connection from said plugged-in position to said unplugged position, thereby disabling said pump means.

8. A liquid fuel dispensing system, comprising:

a liquid fuel reservoir;

a valved nozzle;

a fuel conduit providing fluid communication between said reservoir and said nozzle;

electric pump means in said reservoir for pumping fuel through said conduit, said pump means being connectable to a source of electrical energy;

filter means intermediate said pump means and said nozzle for filtering the fuel that is pumped by said pump means, said filter means including an inner chamber and a cover for providing access to said inner chamber;

means for automatically electrically disconnecting said pump means from the source of energy upon removal of said cover for servicing of said filter means.

9. The dispensing system according to claim 8, wherein said disabling means comprises an interlock mechanism between said cover and said pump means, said interlock mechanism being detachably connected to said cover such that said pump means is automatically disabled upon removal of said interlock mechanism from said cover.

10. The dispensing system according to claim 8, wherein said filter means includes a changeable filter cartridge which is insertable in said inner chamber.

11. The dispensing system according to claim 8, wherein said pump means and said filter means comprise a pump manifold including a plug-type connection which has an unplugged position to prevent the flow of energy to said pump means and a plugged in position to allow the flow of energy to said pump means.

12. The dispensing system according to claim 11, wherein a generally linear interlock mechanism is secured to said pump manifold, one end of said interlock mechanism being connected to said cover and the opposite end of said interlock mechanism being secured to said plug-type connection, whereby removal of said interlock mechanism from said cover moves said plug-type connection from said plugged-in position to said unplugged position, thereby disabling said pump means.

13. A liquid fuel dispensing system, comprising:

a liquid fuel reservoir;

a plurality of dispenser consoles remotely located from said fuel reservoir, each said console including a flexible dispensing hose having a valved nozzle;

a fuel conduit providing fluid communication between said reservoir and each said nozzle;

electric pump means in said reservoir for pumping fuel through said conduit, said pump means being connectable to a source of energy;

filter means in said reservoir intermediate said pump means and each said nozzle for filtering the fuel that is pumped by said pump means, said filter means including an inner chamber and a cover for providing access to said inner chamber;

means for automatically electrically disconnecting said pump means from said source of energy upon removal of said cover for servicing of said filter means.

14. The dispensing system according to claim 13, wherein said disabling means comprises an interlock mechanism between said cover and said pump means, said interlock mechanism being detachably connected to said cover such that said pump means is automatically disabled upon removal of said interlock mechanism from said cover.

15. The dispensing system according to claim 13, wherein said filter means includes a changeable filter cartridge which is insertable in said inner chamber.

16. The dispensing system according to claim 13, wherein said pump means includes a plug-type connection which has an unplugged position to prevent the flow of energy to said pump means and a plugged-in position to allow the flow of energy to said pump means.

17. The dispensing system according to claim 16, wherein a generally linear interlock mechanism is secured to said pump means, one end of said interlock mechanism being connected to said cover and the opposite end of said interlock mechanism being secured to said plug-type connection, whereby removal of said interlock mechanism from said cover moves said plug-type connection from said plugged-in position to said unplugged position, thereby disabling said pump means.

* * * * *